US009549876B2

(12) United States Patent
Runft et al.

(10) Patent No.: US 9,549,876 B2
(45) Date of Patent: Jan. 24, 2017

(54) DEVICE FOR INTRODUCING FILLING MATERIAL INTO CAPSULES

(75) Inventors: Werner Runft, Winnenden (DE); Jens Schlipf, Freiberg A. N. (DE); Walter Boehringer, Remshalden (DE)

(73) Assignee: Robert Bosch GmbH, Stuttgart (DE)

( * ) Notice: Subject to any disclaimer, the term of this patent is extended or adjusted under 35 U.S.C. 154(b) by 562 days.

(21) Appl. No.: 13/992,960

(22) PCT Filed: Nov. 4, 2011

(86) PCT No.: PCT/EP2011/069395

§ 371 (c)(1),
(2), (4) Date: Jun. 10, 2013

(87) PCT Pub. No.: WO2012/079840

PCT Pub. Date: Jun. 21, 2012

(65) Prior Publication Data

US 2013/0255833 A1 Oct. 3, 2013

(30) Foreign Application Priority Data

Dec. 15, 2010 (DE) ..... 10 2010 063 138
Oct. 14, 2011 (DE) ..... 10 2011 084 555

(51) Int. Cl.
*A61J 3/07* (2006.01)

(52) U.S. Cl.
CPC ..... *A61J 3/074* (2013.01)

(58) Field of Classification Search
CPC ..... Y10S 53/90; A61J 3/074; B65B 5/103; B65B 39/145; B65B 1/363; B65B 1/366; B65B 1/04; B65B 1/06
See application file for complete search history.

(56) References Cited

U.S. PATENT DOCUMENTS 479,812 A * 8/1892 Johnston ..... B65B 39/145 141/133
3,656,518 A * 4/1972 Aronson ..... B65B 1/16 141/1

(Continued)

FOREIGN PATENT DOCUMENTS

CN 201098365 8/2008
DE WO 2006106012 A1 * 10/2006 ..... A61J 3/074

(Continued)

OTHER PUBLICATIONS

International Search Report for Application No. PCT/EP2011/069395 dated Feb. 13, 2012 (English Translation and Original, 6 pages).

*Primary Examiner* — Timothy L Maust
*Assistant Examiner* — Andrew Stclair
(74) *Attorney, Agent, or Firm* — Michael Best & Friedrich LLP

(57) ABSTRACT

The present invention relates to a device for introducing filling material (21) into capsules (22), comprising a filling device (25) for feeding filling material (21) to the capsules (22), a capsule holder (30) with at least one row of seats (31) in which the capsules (22) that are to be filled are arranged, a station arrangement with several stations arranged one after another, wherein the station arrangement comprises at least one filling station (5) and a synchronously operating drive, and a movement device which, at the capsule-filling station (5), executes a relative movement between the filling device (25) and the capsule holder (30), wherein the filling device (25) adopts, relative to the capsule holder (30), at least a first filling position for filling a first capsule and a second filling position for filling a second capsule.

10 Claims, 7 Drawing Sheets

(56) References Cited

U.S. PATENT DOCUMENTS

| | | | | |
|---|---|---|---|---|
| 4,731,979 | A | 3/1988 | Yamamoto et al. | |
| 4,959,943 | A * | 10/1990 | Yamamoto | A61J 3/074 53/282 |
| 5,018,335 | A | 5/1991 | Yamamoto et al. | |
| 5,287,897 | A | 2/1994 | Gamberini | |
| 5,966,910 | A | 10/1999 | Ribani et al. | |
| 6,283,176 | B1 | 9/2001 | Wurst et al. | |
| 6,357,490 | B1 * | 3/2002 | Johnston | A61J 3/074 141/144 |
| 6,834,475 | B2 | 12/2004 | Trebbi et al. | |
| 7,792,247 | B2 * | 9/2010 | Schmied | A61J 3/074 378/53 |
| 7,942,173 | B2 | 5/2011 | Morimoto et al. | |
| 8,151,830 | B2 | 4/2012 | Schmied et al. | |
| 2004/0081689 | A1 | 4/2004 | Dunfield et al. | |
| 2004/0261897 | A1 * | 12/2004 | Carlson | B01F 3/188 141/130 |
| 2009/0050446 | A1 * | 2/2009 | Cliff | B65D 90/56 198/546 |
| 2009/0229705 | A1 | 9/2009 | Ansaloni | |
| 2010/0078093 | A1 * | 4/2010 | Ansaloni | A61J 3/074 141/284 |
| 2011/0146843 | A1 * | 6/2011 | Ansaloni | A61J 3/074 141/369 |

FOREIGN PATENT DOCUMENTS

| | | |
|---|---|---|
| JP | 6264702 | 3/1987 |
| JP | 2010070219 | 4/2010 |
| WO | 95/11658 | 5/1995 |
| WO | 9741031 | 11/1997 |
| WO | 03016137 | 2/2003 |

* cited by examiner

DEVICE FOR INTRODUCING FILLING MATERIAL INTO CAPSULES

BACKGROUND OF THE INVENTION

The present invention relates to a device for introducing filling material, in particular powdery filling material, into capsules.

Capsules, e.g. from gelatin, which are produced from substantially cylindrical hollow forms with hemispherical end regions, are used frequently, in particular for medicines. One half of the capsules is filled with a filling material, in particular a medicine, and then the other half of the capsule is placed thereon in order to obtain a closed capsule. In this connection, the filling of the capsule is effected in filling machines which have to ensure a high level of precision when introducing the respective quantities in order to prevent faulty dosings of a medicine. This is why longer capsule filling times are frequently produced, which restricts a production capacity of a filling machine. DE 199 15 259 A1 makes known, for example, a device for dosing and introducing powdery filling material into containers where two filling units are arranged next to each other in a row. In this connection, it is possible, in particular, to effect a part filling by means of the first filling unit and a subsequent final filling by means of the second filling unit.

SUMMARY OF THE INVENTION

In contrast, the advantage of the device for introducing filling material into capsules is that, compared to the known devices, an increase in performance is achieved by means of filling the capsules in an improved manner. In this connection it is possible to dispense with, in particular, several filling stations and nevertheless to achieve a rapid fill time. This is achieved in that the device includes a filling device for filling the capsules and a capsule holder, the capsule holder having at least one row of several accommodating means in which the capsules to be filled are arranged. In addition, there is provided a station arrangement having a plurality of stations which are arranged one after the other. In this connection, there is provided a movement apparatus which enables a relative movement between the filling device and the capsule holder at a capsule filling station, wherein the filling device, in relation to the capsule holder, assumes at least one first filling position for filling a first capsule and one second filling position for filling a second capsule. This means that all the capsules accommodated in the capsule holder can be filled by means of one single filling device by providing the relative movement between the filling device and the capsule holder by assuming several filling positions. Consequently, the filling device can fill the capsules located in the capsule holder both in the first and the second filling position. In addition, the device is distinguished in particular by very low structural expenditure.

In a particularly preferred manner, the station arrangement includes a station wheel having a plurality of capsule holders. This means that a very efficient operating cycle can be achieved during the filling operation. The movement apparatus, in this case, carries out a relative movement between the filling device and the capsule holder in the radial direction.

In this case, a relative movement between the filling device and the capsule holder in a first direction and a second direction is preferably possible in a horizontal plane. This means that, in particular, several parallel rows of capsules are able to be filled. In a particularly preferred manner, in this case, the first direction is perpendicular to the second direction.

In addition, in a preferred manner, the filling station has a dosing wheel and a hopper funnel for accommodating the filling material. As a result, an operationally reliable guiding of the filling material into the dosing wheel can be achieved without a large amount of structural expenditure.

Furthermore, the filling station has a particularly compact design and a sufficient filling amount can easily be introduced into the various filling positions.

The dosing wheel has at least one first filling chamber and one second filling chamber and during a movement operation the dosing wheel is rotated from the first filling position to the second filling position in order to move a filling chamber filled with filling material into the filling position and to fill up the empty filling chamber again. As a result of the simultaneous movements of the dosing wheel and of the capsule holder, fillings of capsules can be carried out both in the first filling position and in the second filling position in rapid succession.

A filling operation of a capsule at the capsule filling station by means of the filling device is the shortest of all the individual operations in the station arrangement. In a particularly preferred manner, a filling operation in the capsule filling station, in this case, lasts half as long as the next shortest operation in a station.

In a particularly preferred manner, the capsule holder includes a first row of accommodating means and a second row of accommodating means, which are arranged parallel to each other. This means that a plurality of capsules can be arranged over a small area. In a further preferred manner, even more rows parallel to each other, e.g. three or four or five rows, can be arranged.

The device additionally includes a second capsule filling station with a second filling device. This means that it is possible, for example, for a part filling of the capsules to be effected in the first filling station and a final filling of the capsules to be effected in a second filling station.

The movement apparatus is arranged at the filling device and the filling device is moved in relation to the capsule holder. This means a high degree of variability of the relative movement between the filling device and the capsule holder can be ensured.

The movement apparatus preferably includes a driven cam disk or a linear motor or a servomotor. As a result, an operationally reliable movement of the movement apparatus in the radial and vertical direction is possible with short cycle times. As an alternative to this, intermediate gearing or a slide combined with a coupling means or guiding means can be provided as an intermediate member between the motor and the filling device in order to convert a generated vertical movement into a horizontal movement by means of a guiding means. In addition, a threaded drive (rack/pinion) can also be used for this purpose. As an alternative to this, it is also possible for the drive to be positioned under the machine plane or base plate of the station.

As an alternative to this or in addition, the movement apparatus is arranged at the capsule holder in order to move the capsule holder in relation to the filling device. However, it is disadvantageous in this connection, in particular when using a station wheel, for the capsule holder to have to be removed from the station wheel and to have to be moved in relation to the filling device.

In addition, in a preferred manner the movement apparatus includes a guiding element with a curved path. As a result, an operationally reliable radial movement of the capsule holder is achieved with a minimized number of components and with the space occupied being compact.

A connecting link guide is provided additionally in order to move the capsule holder into a first position and a second position. As a result, a radial movement of the capsule holder is made possible when the device is at a standstill. Consequently, once the capsules located in the first row of the accommodating means have been filled, positioning onto the second row of the capsule holder can be effected in a simple manner and afterwards all the capsules located therein can be filled one after the other. As a result, improved machine efficiency is achieved with shorter cycle times. The drive of the connecting link, in this connection, can be effected in a purely mechanical manner or via a cam gear by means of a linear motor or servomotor. In the case of smaller outputs, the use of a pneumatic drive is also possible as an alternative.

For a rapid filling operation, the filling device preferably includes several filling units which are arranged in a row in order to fill several capsules of one row at the same time. In a particularly preferred manner, in this case, a number of filling units corresponds to a number of capsule accommodating means in a row of the capsule holder. In a further preferred manner, the filling device is a pressure/vacuum filling device, a fill amount being sucked in by means of vacuum and output by means of pressure.

The filling device preferably includes a flexible product supplying means which is provided between the storage hopper and the filling station. Consequently, it is possible to supply a product to the moving filling station in an optimum manner. For better cleaning and in order to prevent influences on the properties of the product, it is advantageous for the supplying means to be produced from steel and to be developed in a pivotable manner. Flexible seals are provided in each case between the storage hopper or the filling station and the pivotable product supplying means.

BRIEF DESCRIPTION OF THE DRAWINGS

Preferred exemplary embodiments of the invention are described below with reference to the accompanying drawing, in which, in detail.

DETAILED DESCRIPTION

A device 20 for introducing powdery filling material 21 according to a first preferred exemplary embodiment is described in detail below with reference to FIGS. 1 to 5.

Figure 1:
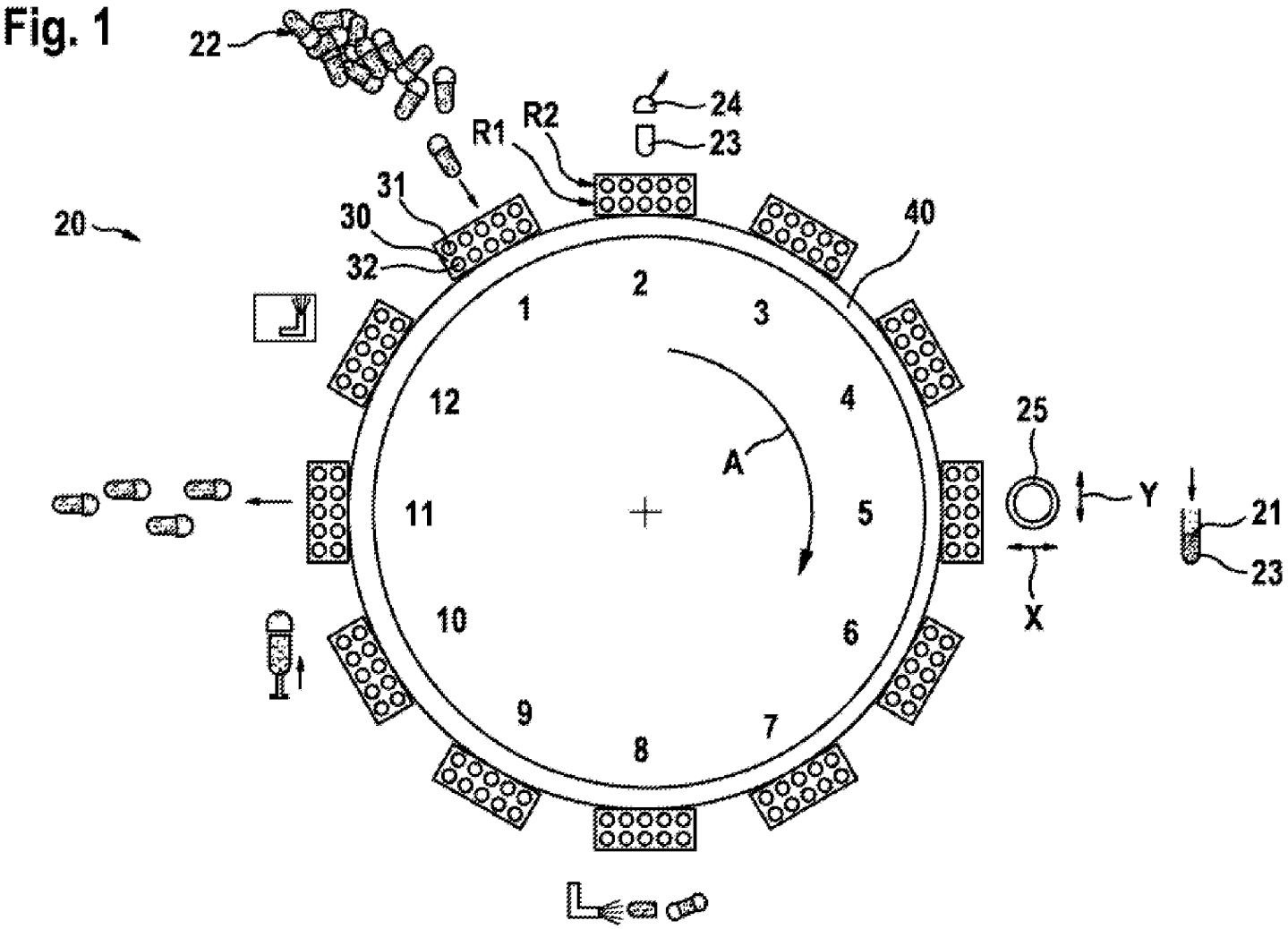
FIG. 1 shows a schematic top view of a device for introducing filling material according to a first exemplary embodiment of the invention.

FIG. 1 shows an overall view of the device 20 which includes a station wheel 40 having a total of twelve stations 1 to 12. A total of twelve capsule holders 30 are arranged along the circumference of the station wheel 40, each capsule holder 30 having a plurality of accommodating means 31, 32 for accommodating capsules 22. The accommodating means 31, 32, in this case, are arranged in two rows, namely a first row R1 and a second row R2, parallel to each other in each capsule holder 30. A direction of rotation of the station wheel 40 is marked by the arrow A.

The stations of the station wheel 40, in this case, are as follows. Empty, closed capsules, which include a capsule bottom part 23 and a capsule top part 24, are supplied from a hopper to the station 1. The capsules, in this case, are inserted individually in each case into an accommodating means 31 of the capsule holder 30.

The capsules 22 are opened at the station 2, i.e. the capsule top part 24 is removed from the capsule bottom part 23 such that the capsule bottom part 23 remains in the accommodating means 31.

It should be noted that it is also possible for the supplying and opening of the capsules to be effected at the same station. It is also possible for the first row to be filled with capsules at station 1 and the second row to be filled with capsules at station 2 and for opening to take place preferably at the same time at the stations.

The stations 3 and 4 are not occupied in this exemplary embodiment.

Figure 2:
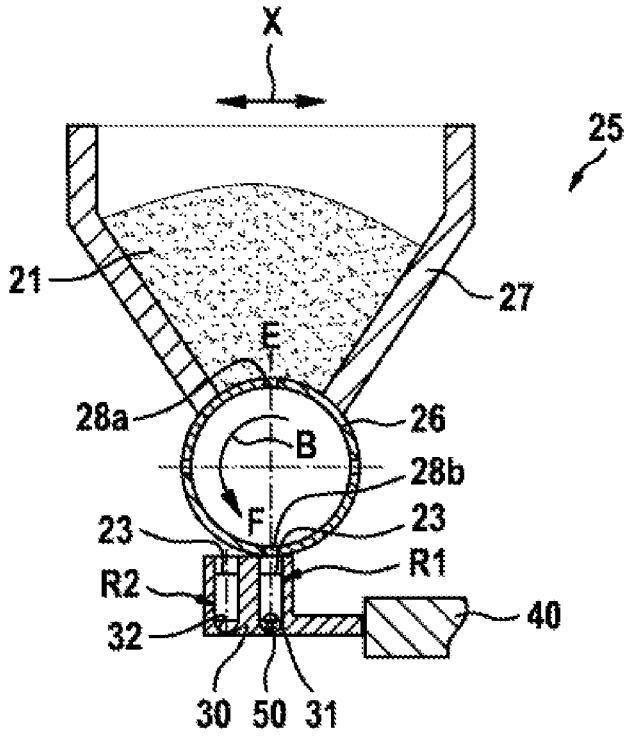
FIG. 2 shows a schematic sectioned view through a filling device of FIG. 1 in a first position.
Figure 3:
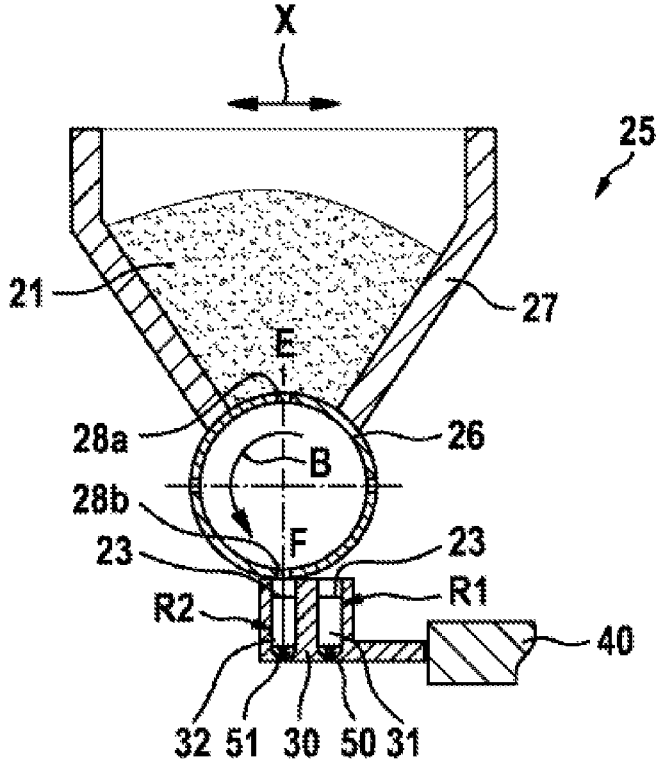
FIG. 3 shows a schematic sectioned view through a filling device of FIG. 1 in a second position.

The station 5 is a filling station in which the opened capsules 22 are filled. A filling device 25 which is shown in detail in FIGS. 2 and 3 is provided for this purpose. The filling device 25 includes a dosing wheel 26 and a hopper funnel 27 in which the powdery filling material 21 is arranged. The filling device 25 includes a movement apparatus (not visible here) which moves the filling device 25 in two directions, namely a first direction X and a second direction Y. The two directions X, Y, in this case, are perpendicular to each other (cf. FIG. 1) and move the filling device 25 in a horizontal plane. The movement apparatus, in this case, preferably includes two separate drives which move the filling device 25 in the two directions X, Y. FIG. 2, in this case, shows an initial position of the filling operation, the filling device 25 being arranged above an accommodating means 31 of the first row R1 of the accommodating means and being consequently positioned in a first filling position. The dosing wheel 26 has a first dosing chamber 28*a* and a second dosing chamber 28b. In the position shown in FIG. 2, a small filling amount 50 is sucked into the first dosing chamber 28*a* by means of a vacuum at an accommodating position E. The dosing wheel 26 is then rotated by 180° in the direction of the arrow B and by means of compressed air outputs the small filling amount 50 at a discharging position F such that the filling amount 50 falls into the capsule bottom part 23. As can be seen from FIG. 3, the filling device 25 then carries out a movement in the direction X such that the discharging position F is consequently positioned in a second filling position above an accommodating means 32 of the second row R2. A second filling amount 51 is then filled in the same way into the capsule bottom part 23 in the accommodating means 32 of the second row R2. In order then to fill the next capsule bottom part 23 in the accommodating means following in the second row R2, the filling device 25 is moved in the direction Y and the capsule bottom part 23 in the next accommodating means is filled. The filling device 25 can then be moved in the X direction again in order to fill the next capsule bottom part 23 in the first row R1. As an alternative to this, it is also possible, once the capsule bottom part 23 filled beforehand in the first row R1 has been filled, to move the filling device in the second direction Y to a second filling position in order to fill a further capsule bottom part 23 in the first row R1. In the same way, once the capsule bottom part 23 in the second row R2 has been successfully filled beforehand, it is also possible to effect a movement in the second direction Y in order to fill a further capsule bottom part 23 in the second row R2. Consequently, by means of horizontal relative movements of the filling device 25 following one after the other in an arbitrary manner in the first or second directions X, Y to the respective first and second filling positions, it is possible to fill all the capsule bottom parts 31 of a capsule holder 30 in a variable sequence. As the storage hopper 27 is always entrained, there is always a sufficient amount of filling material 21 present. In a particularly preferred manner, it is also possible for the dosing wheel 26 to have four dosing chambers which are arranged at an angle of 90° with respect to one another, the dosing wheel 26 being rotated on in each case by 90°, in this connection, for the accommodating and discharging of the filling material 21. It should be noted that, as an alternative to this, the filling device can also include several filling units in a row, the number of filling units being the same as the number of the accommodating means 31, 32 in the row R1 and R2 or being a multiple or a part amount thereof Where applicable, another further filling device can also be provided at the station 6 such that, for example, the first filling device performs a part filling at the station 5 and the second filling device 6 performs a concluding final filling and precise dosing of the filling amount.

A weighing device, for example, can be provided at the station 7 in order to check the filled capsules.

The station 8 is an ejector station where the damaged or non-filled or wrongly filled capsules can be rejected.

At the station 9, the capsule top parts 24 are again positioned above the now filled capsule bottom parts 23 and in the station 10 the capsules are closed again. This can be effected, for example, by lowering the capsule top parts onto the capsule bottom parts.

The station 11 is the discharging station for the filled capsules and the station 12 is a cleaning station in which the capsule holders 30 are cleaned in order to avoid faulty fillings or to avoid receiving the capsules wrongly in the accommodating means 31.

Figure 4:
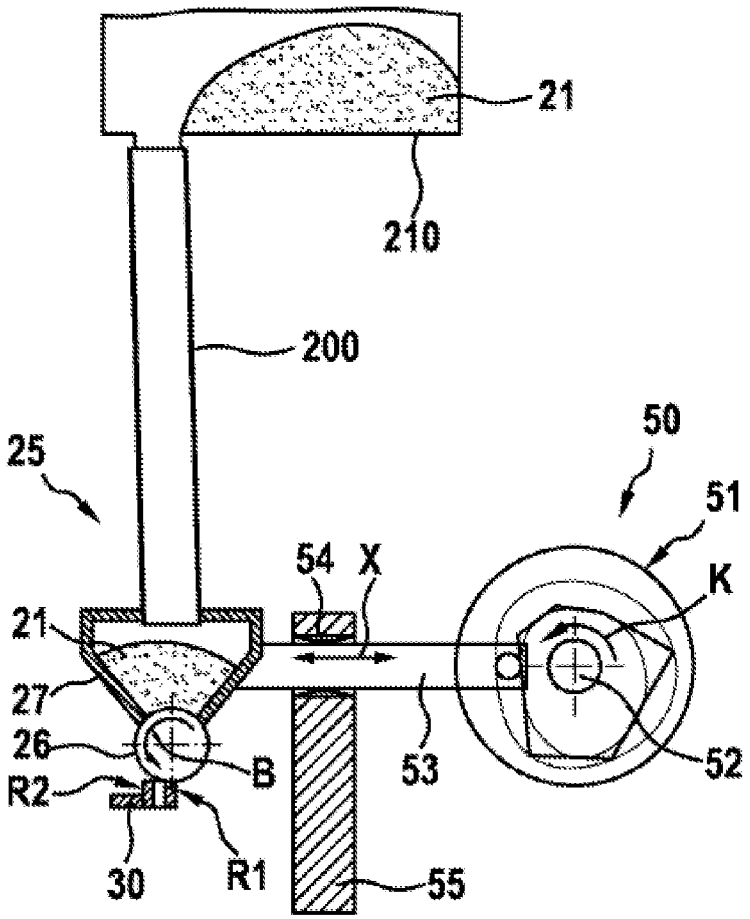
FIG. 4 shows a schematic sectioned view of a movement apparatus for the filling device of FIGS. 2 and 3.

FIG. 4 shows a movement apparatus 50 which is arranged at the filling device 25 and carries out a relative movement between the filling device 25 and the capsule holder 30 in the X direction. As can be seen from FIG. 4, the movement apparatus 50, in this connection, includes a slide 53 which is fastened by way of one end to the filling device 25 and is supported or mounted in a holding device 55 so as to be displaceable by means of a bearing arrangement 54. The opposite end of the slide 53 is rotatably fastened on a cam disk 51 which is moved by a drive 52, e.g. a servomotor, in the direction of the arrow K and consequently moves the slide 53 together with the filling device 25 in the X direction. As a result, the filling device 25 is displaced from the position shown in FIG. 4 above the first row R1 into the position above the second row R2 of the capsule holder 30. Corresponding to the shape of the cam disk 51, a subsequent rotation of the driven cam disk 51 effects a corresponding movement in the reverse X direction. The movement apparatus 50 and the filling device 25, in this exemplary embodiment, are arranged substantially in a common plane.

As can also be seen from FIG. 4, the filling device 25 also has a flexible product supplying means 200 which is realized in a tubular manner and is pivotably arranged between a storage hopper 210 and the hopper funnel 27. The achievement here is that the filling material 21 is supplied in a optimum manner from the storage hopper 210 to the moving filling station 25.

Figure 5:
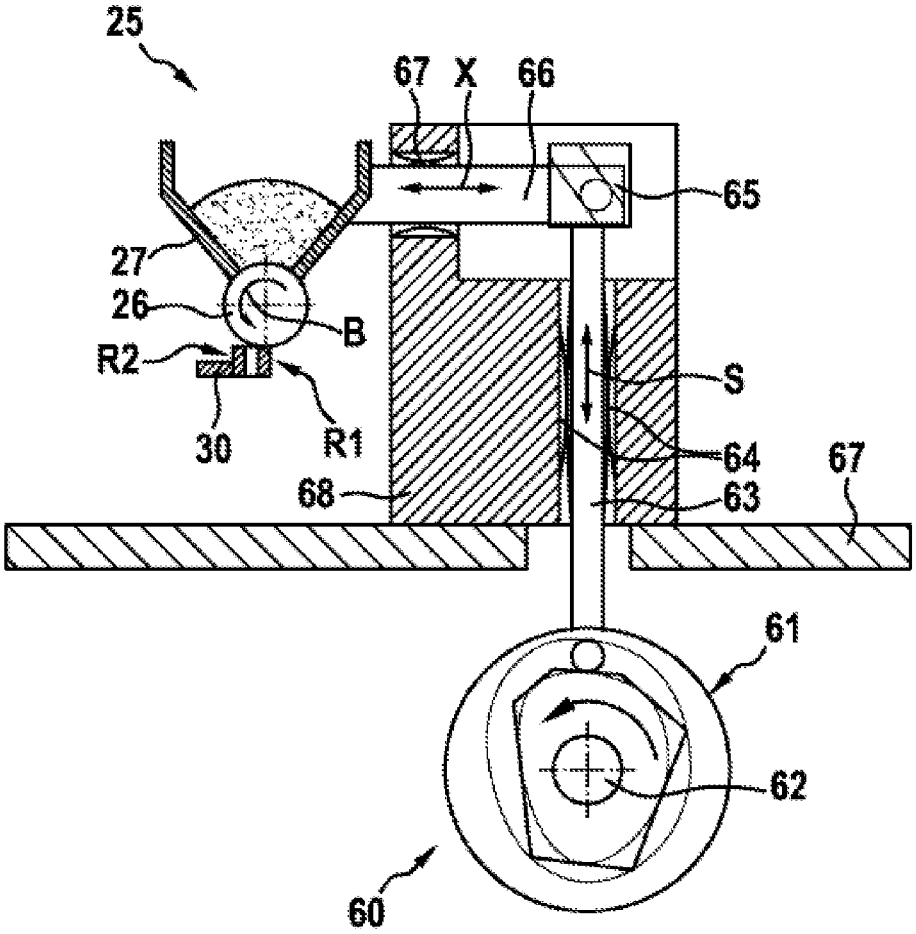
FIG. 5 shows a schematic sectioned view of an alternative movement apparatus for the filling device of FIGS. 2 and 3.
Figure 6:
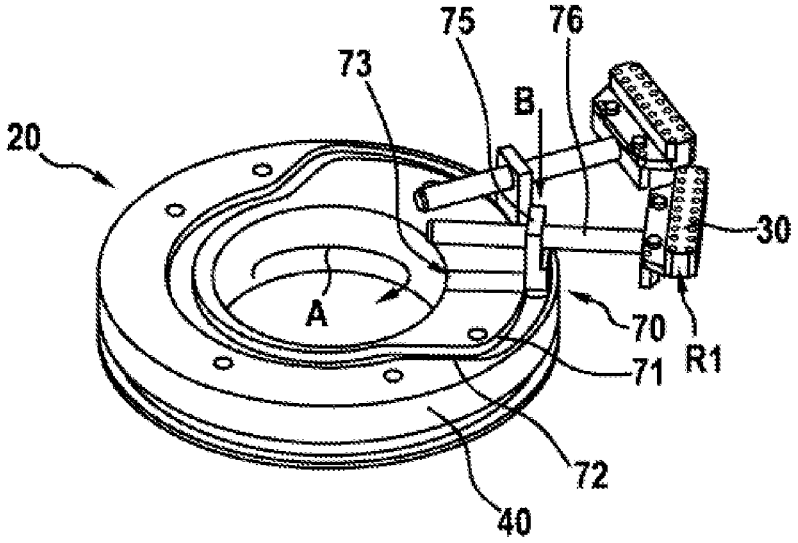
FIG. 6 shows a perspective view of a second embodiment of a movement apparatus including connecting link guide in a first position.
Figure 7:
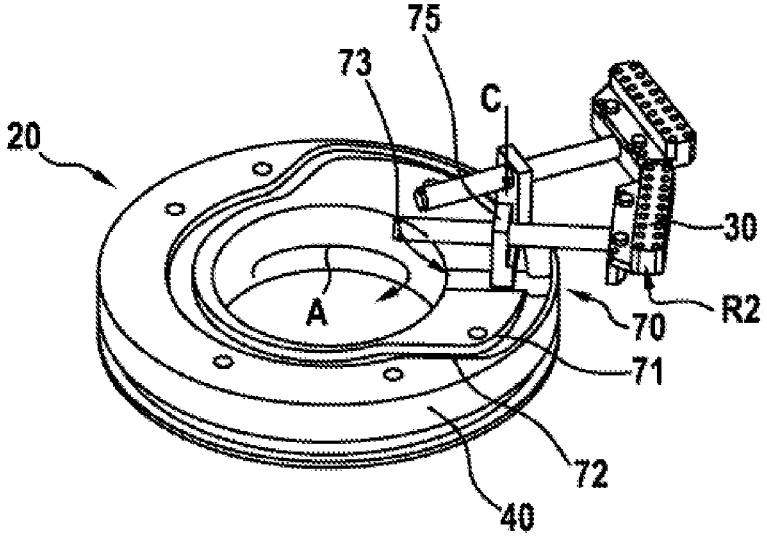
FIG. 7 shows a perspective view of the movement apparatus of FIG. 6 in a second position.
Figure 8:
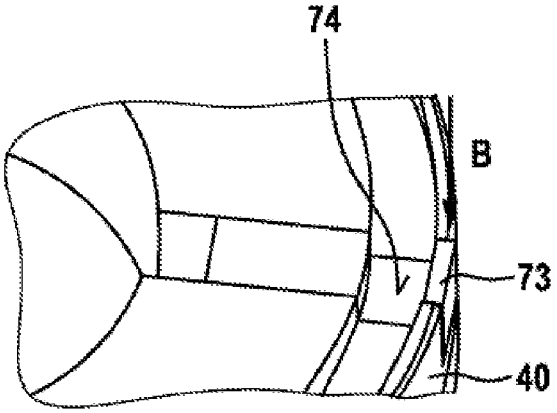
FIG. 8 shows an enlarged view of the connecting link guide in the first position of FIG. 6

As shown in FIG. 5, a movement apparatus 60 can also be provided as an alternative to this, a cam disk 61 of said movement apparatus is arranged together with drive 62 below the base plate 67 of the station 5. The movement apparatus 60 has a holding device 68 which is mounted on the base plate 67, in which holding device a first slide 63 is supported so as to be displaceable by means of a first bearing arrangement 64. One end of the slide 63 is rotatably connected to the cam disk 61 which is driven by a drive 62, preferably in the form of a servomotor. The opposite end of the first slide 63 is connected via a guide 65 to a second slide 66 which is displaceably mounted in the holding device 68 by means of a second bearing arrangement 67.

As can be seen from FIG. 5, in this connection a substantially perpendicular movement of the first slide 63 in a direction S is generated into a movement in the direction X which brings about the displacement of the filling device 25 from the first row R1 to the second row R2 of the capsule holder 30. A drive for the movement of the filling device 25 in the Y direction is not shown in each case in FIGS. 4 and 5 to simplify the representation, it being possible for the drive in the Y direction to be constructed in an identical manner to that in the X direction. As an alternative to this, it is also possible to provide a linear drive.

Accordingly, an operationally reliable movement of the movement apparatus 50 or 60 between the filling device 25 and the capsule holder 30 with a high degree of variability is made possible. In addition, rapid filling of the capsules with clearly reduced cycle times is ensured as a result. Moreover, it is possible to adapt or incorporate the movement apparatus 50, 60 in a flexible manner corresponding to the respective space available at the station wheel 40 of the device 20.

With reference to FIGS. 6 to 9, a device 20 for introducing powdery filling material according to a second preferred exemplary embodiment is described in detail below. Identical or operationally identical components are designated here with the same references as in the first exemplary embodiment.

Contrary to the previously described first exemplary embodiment, the device 20 in the case of said second exemplary embodiment includes a movement apparatus 70 which is arranged at the station wheel 40 and carries out a relative movement between the filling device 25 and the capsule holder 30 in the radial direction or the X direction. To this end, the movement apparatus 70 has a guiding element 71 with a curved path 72. In addition, a connecting link guide 73 with a recess 74 realized therein (cf. FIG. 8) is provided on the guiding element 71. A support 75 (cf. FIG. 6) is fastened in the recess 74, by means of which support a capsule holder 30 is fastened on the movement apparatus 70 by means of a rod 76 fixed in the support 75.

In the case of the rotational movement A of the station wheel 40, the capsule holder 30 is moved corresponding to the shape of the curved path 72 in the radial direction or X direction in relation to the filling device 25 (not shown here). The connecting link guide 73, in this case, is situated in a first position B, which is shown by an arrow in each case in FIG. 6 and FIG. 8, such that a row R1 of capsule bottom parts 23 (cf. FIG. 6) located in the capsule holder 30 are able to be filled.

Figure 9:
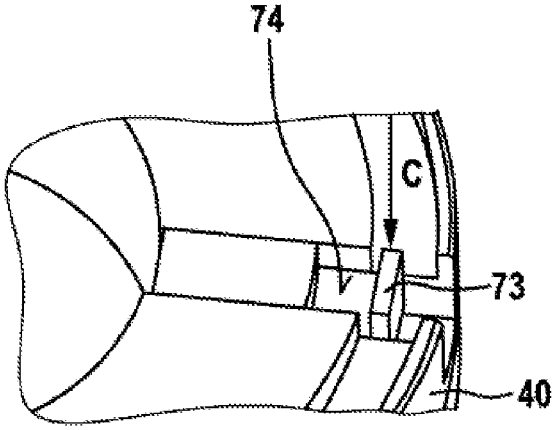
FIG. 9 shows an enlarged representation of the connecting link guide in the second position of FIG. 7.

To fill the capsule bottom parts 23 which are located in an adjacent row R2, the connecting link guide 73, with the station wheel 40 at a standstill, is displaced from the first position B into a second position C, which is shown by an arrow and is illustrated in FIG. 9. In the second position C of the connecting link guide 73, a filling of capsule bottom parts 23 in a second row R2 of a capsule holder 30' positioned in such a manner can then be effected (cf. FIG. 7).

It should be noted that, as an alternative to this, a combination of the two previously described movement apparatuses is also possible such that both the filling device and the capsule holder are able to be moved. This means that more rapid positioning of the capsule holder used and of the filling station is possible, as a result of which a further increase in the machine efficiency is achievable in the individual case. However, machine expenditure is also increased as a result. It should further be noted that the filling device 25 has a fill time which is half of a time of a station with the second-shortest processing time. This means that it is possible to maintain a predetermined clock pulse of the station wheel 40 in a very good manner, it being possible to fill both the first row R1 and the second row R2 of the capsule holder 30 in only one station in particular when a filling device with five filling units is used.

The device for introducing filling material 21 into capsules 22 is preferably used for filling capsules with medicines.

The invention claimed is:

1. A device for introducing filling material (21) into capsules (22), said device including:

a filling device (25) for supplying filling material (21) to the capsules (22), a capsule holder (30) with accommodating receptacles (31) in which the capsules (22) to be filled are arranged, the capsule holder (30) includes a first row (R1) of accommodating receptacles (31) and a second row (R2) of accommodating receptacles (31), wherein the first and second rows are arranged parallel to each other;

a station wheel (40) operable by a drive which operates in a fixed cycle to move the capsule holder (30) to several stations which are arranged one after the other, the several stations including a capsule filling station (5), and a movement apparatus (50; 60) which carries out a relative movement between the filling device (25) and the capsule holder (30) at the capsule filling station (5), the movement apparatus (50; 60) is arranged at the filling device (25) and moves the filling device (25) in relation to the capsule holder (30) in a radial direction (X) between a first filling position and a second filling position to enable filling of capsules (22) in both the first and second rows (R1, R2), and wherein the filling device (25) has a dosing wheel (26) and a hopper funnel (27) for accommodating the filling material (21), the dosing wheel (26) being rotatable about an axis that is normal to the radial direction (X).

2. The device as claimed in claim 1, characterized in that the filling device (25) is further movable in a tangential direction (Y), wherein the radial direction (X) is perpendicular to the tangential direction (Y).

3. The device as claimed in claim 1, characterized in that the dosing wheel (26) has at least one first filling chamber (28*a*) and one second filling chamber (28b) and during a movement operation the dosing wheel (26) is rotated from the first filling position to the second filling position in order to fill one of the filling chambers (28*a*, 28*b*) with filling material.

4. The device as claimed in claim 1, characterized by a second capsule filling station (5) with a second filling device.

5. The device as claimed in claim 1, characterized in that the movement apparatus (50, 60) includes a driven cam disk (50) or a linear motor or a servomotor.

6. The device as claimed in claim 1, characterized in that the filling device (25) includes several filling units in order to fill several capsules in the accommodating receptacles (31) of a row (R1, R2) at the same time, wherein the number of filling units corresponds to the number of accommodating receptacles (31) in a row and wherein the filling device is a pressure/vacuum filling device.

7. The device as claimed in claim 1, characterized in that the filling device (25) includes a flexible product supplying conduit (200).

8. The device as claimed in claim 1, characterized in that the movement apparatus (50; 60) includes a driven cam disk (51; 61) that drives movement of the filling device (25) between the first and second filling positions.

9. The device as claimed in claim 8, characterized in that the movement apparatus (60) further includes a first slide (63) having a first end rotatably connected to the cam disk (61) and a second end connected to a second slide (65) such that rotation of the cam disk (61) causes translation of the first slide (63) to drive translation of the second slide (65) in the radial direction (X) to move the filling device (25) between the first and second filling positions.

10. The device as claimed in claim 8, characterized in that the movement apparatus (50) further includes a slide (53) having a first end rotatably connected to the cam disk (51) such that rotation of the cam disk (51) causes translation of the slide (53) in the radial direction (X) to move the filling device (25) between the first and second filling positions.

* * * * *